US006692378B2

(12) United States Patent
Shmoldas et al.

(10) Patent No.: US 6,692,378 B2
(45) Date of Patent: Feb. 17, 2004

(54) GOLF CLUB HEAD WITH ALIGNMENT CHANNEL

(75) Inventors: Andre Shmoldas, Oceanside, CA (US); Brian Pond, San Marcos, CA (US); Jim McGeeney, Poway, CA (US); Tom Morris, Carlsbad, CA (US)

(73) Assignee: Roger Cleveland Golf Company, Inc., Cypress, CA (US)

( * ) Notice: Subject to any disclaimer, the term of this patent is extended or adjusted under 35 U.S.C. 154(b) by 0 days.

(21) Appl. No.: 10/059,735

(22) Filed: Jan. 28, 2002

(65) Prior Publication Data

US 2002/0103039 A1 Aug. 1, 2002

Related U.S. Application Data

(60) Provisional application No. 60/264,459, filed on Jan. 26, 2001, and provisional application No. 60/264,339, filed on Jan. 26, 2001.

(51) Int. Cl.[7] ..... A63B 53/04

(52) U.S. Cl. ..... 473/340; 473/341; 473/342; 473/346

(58) Field of Search ..... 473/251, 340, 473/341, 347, 349, 342, 346; D21/733, 734, 736, 750

(56) References Cited

U.S. PATENT DOCUMENTS

| | | | | | |
|---|---|---|---|---|---|
| 4,655,459 | A | * | 4/1987 | Antonious | 273/171 |
| 4,828,265 | A | * | 5/1989 | Antonious | 273/167 |
| 5,308,067 | A | | 5/1994 | Cook | 273/164.1 |
| 5,482,281 | A | * | 1/1996 | Anderson | 273/169 |
| 5,575,472 | A | | 11/1996 | Magerman et al. | 29/530 |
| 5,580,058 | A | | 12/1996 | Coughlin | 273/250 |
| 5,655,976 | A | * | 8/1997 | Rife | 473/340 |
| 5,690,562 | A | | 11/1997 | Sturm | 473/340 |
| 5,842,935 | A | * | 12/1998 | Nelson | 473/342 |
| 5,913,731 | A | | 6/1999 | Westerman | 473/251 |
| 5,924,939 | A | * | 7/1999 | Grace et al. | 473/324 |
| 5,938,543 | A | | 8/1999 | McGeeney et al. | 473/324 |
| 5,951,412 | A | * | 9/1999 | Rose et al. | 473/340 |
| D458,657 | S | * | 6/2002 | Shmoldas et al. | D21/743 |

FOREIGN PATENT DOCUMENTS

| | | |
|---|---|---|
| EP | 0 891 790 | 1/1999 |

* cited by examiner

*Primary Examiner*—Paul T. Sewell
*Assistant Examiner*—Thanh P Duong
(74) *Attorney, Agent, or Firm*—Parkhurst & Wendel, L.L.P.

(57) ABSTRACT

The present invention relates to a golf club having a golf club head with a channel on the head. The golf club head may be a putter-type club head that is used to putt the golf ball on a green. The use of the channel on the club head provides a mass distribution that can result in a high moment of inertia so that the club head resists twisting in the player's hand when the club head strikes a golf ball. The channel also assists a player in aligning the club head to strike a golf ball. The channel may be located on the upper face of the club head so that the player can see the channel when addressing a golf ball with the golf club. The channel extends from a front, strike face of the club head to a rear face of the club head and is preferably aligned with an axis that corresponds to the desired direction of travel of a golf ball that is struck with the club head.

9 Claims, 8 Drawing Sheets

GOLF CLUB HEAD WITH ALIGNMENT CHANNEL

REFERENCE TO RELATED APPLICATIONS

This application claims priority of co-pending U.S. Provisional Patent Application Serial No. 60/264,459 entitled "Golf Club head with Alignment Channel" by Shmoldas et al., filed Jan. 26, 2001, and co-pending U.S. Provisional Patent Application Serial No. 60/264,339 entitled "Low Density Polymer Composite Segment For Multiple Density Golf Club Head" by Shmoldas et al., filed Jan. 26, 2001. Priority of the filing dates of Jan. 26, 2001 of the Provisional Patent Applications is hereby claimed, and the disclosures of the Provisional Patent Applications are hereby incorporated by reference.

BACKGROUND OF THE INVENTION

1. Field of the Invention

The present invention relates generally to golf clubs and, more particularly, to a golf club head having a configuration that enhances the accuracy of a golf shot.

2. Description of the Related Art

There are a variety of golf clubs types that a player may use in the course of a round of golf. The woods are the clubs that are generally used to shoot the ball over the longest distances, such as when the player is shooting the golf ball from the tee box. The irons are generally used to shoot the ball over intermediate distances, such as when the player is shooting the ball from a fairway or when the player is in the rough and nearer the green. Another type of club is the putter, which a player generally uses on the green where the hole is located to sink the ball into the hole.

There are also a variety of club designations within the general club types that are described above. For example, the woods can include the driver, which the player uses to shoot the ball the longest distance off the tee, and the fairway woods, which the player uses in the fairways and to shoot the ball shorter distances off the tee. The irons also include various designations, such as short irons, long irons, and wedges, each of which provide different characteristics in regard to hitting the golf ball. Moreover, depending on the player's preferences, there are various overlaps in use and function of woods and irons, as well as overlaps within the clubs designations. For example, some players may prefer to hit a fairway wood off of the tee rather than a driver, while other players may prefer to hit an iron off of the tee. Some players may only use an iron in when hitting off of the rough while other players may prefer a fairway wood or a hybrid club that combines the characteristics of a wood and an iron. Given the variance in the skill levels and preferences of golfers, a bottom line rule is that there is no one club that every player would most likely use in a given situation. Even when the ball is locate in a sand bunker, a player might use a club other than a sand wedge depending on the distance to the green.

There is, however, one exception to this rule. Most golfers would likely agree that the putter should always be used when the golf ball is on the green. Unlike the irons and woods, which have a variety of uses, the sole purpose of a putter is to shoot the ball on the green into the hole. Consequently, unless a player sinks a ball in the hole from off the green, the putter is usually the only club in a player's set that the player uses on every single hole in a round of golf. The success of player's use of a putter thus has a great impact on the player's overall success in a round of golf, more so than any other club in the player's arsenal. There are various factors that impact the success of a player's use of a putter, the factors including the player's equipment (i.e., the putter itself) as well as the player's putting technique.

In regard to equipment, golf club manufacturer's have produced a variety of putter designs that are configured to increase the likelihood of a player having a successful putting game. For example, the putter described in U.S. Pat. No. 5,938,543, which is assigned to the same assignee as the present application, has weighting characteristics that are configured to improve the player's putting. However, even where a player uses optimal equipment, other factors such as the player's technique, distance to the hole, and the line of sight to the hole, will affect the putt.

Like many aspects of golf, the putting technique is relatively simple in theory, but difficult in practice. The basic idea of putting is to align the putter so that the strike face is perpendicular to the target and then strike the ball with the strike face so that so that the ball is propelled toward the target. When putting the ball, the player has to also take into account various factors, such as the contour and slope of the green and the distance to the hole. Even if the player hits the ball with the correct ball speed, the ball will not travel in the desired direction if the player does not correctly align the putter with the target. Proper alignment of the putter head with respect to the target can be difficult for many player's even where the putting distance is short. As a result, a player that is using high-end equipment and that uses proper putting body mechanics may miss a putt simply because the putter head is not correctly aligned with the target.

In view of the foregoing, there is a need for a golf club head having a design configuration that takes into account the various factors that contribute to the success of a player's golf game to increase the likelihood of a player successfully striking a golf ball, such as during a putt.

SUMMARY OF THE INVENTION

The present invention relates to a golf club having a golf club head with a channel on the head. The golf club head may be a putter-type club head that is used to putt the golf ball on a green. The use of the channel on the club head provides a mass distribution that results in a high moment of inertia so that the club head resists twisting in the player's hand when the club head strikes a golf ball. The channel also assists a player in aligning the club head to strike a golf ball. The channel is preferably located on the upper face of the club head so that the player can see the channel when addressing a golf ball with the golf club. The channel extends from a front, strike face of the club head to a rear face of the club head and is preferably aligned with an axis that corresponds to the desired direction of travel of a golf ball that is struck with the club head. In one embodiment, the channel has a width that is greater than the diameter of a golf ball so that the ball can be framed by the channel.

In one aspect of the invention, a golf club head comprises a body having a front strike face configured to strike a golf ball and a back face that is generally opposed to the front strike face. The body further has a bottom surface and an opposed top surface, wherein a channel is located in the top surface of the club head. The channel extends from the front strike face to the back strike face such that the channel forms a first indentation in an upper region of the front strike face and a second indentation in an upper region of the back face of the club head.

In another aspect of the invention, the body of the golf club head includes plural segments that are attached together to collectively form the body. The plural segments include a heel segment that extends from the strike face to the back face. The heel segment is located in a heel region of the club head and is formed of a first material having a first density. The plural segments also include a toe segment that extends from the strike face to the back face and that is located in a toe region of the club head. The toe segment is formed of a second material having a second density. A center segment extends from the strike face to the back face and is located between the heel segment and the toe segment.

In yet another aspect of the invention, the center segment comprises an inner core, a shell surrounding the inner core, and an overmold surrounding the shell. A front face of the overmold forms at least a portion of the strike face of the club head.

Other features and advantages of the present invention should be apparent from the following description of the preferred embodiment, which illustrates, by way of example, the principles of the invention.

DETAILED DESCRIPTION

The golf club head described herein has certain features, and the following description and claims employ directional and reference words relating to those features. The ball striking surface or "strike face" of the club head, which is intended to hit the golf ball, is located on the "front" of the club head. The "back" of the club head is the portion of the club head that is opposed to the front. The terms "top" and "bottom" assume that the club head is oriented as it would be if the golf club were held by a golfer in an at-rest position, i.e., the bottom of the club head would contact the ground when at rest. The top of the club head is referred to as the "crown" and the bottom of the club head is referred to herein as the "sole". The "heel" of the club head is the portion of the club head nearest the golfer when the golfer holds the club in an at-rest position and the "toe" is the portion of the club head furthest from the golfer. The term "lateral" is used to refer to the dimension of the club head in the direction between the heel and toe. Thus, the heel of the club head is located laterally opposite the toe of the club head.

Figure 1:
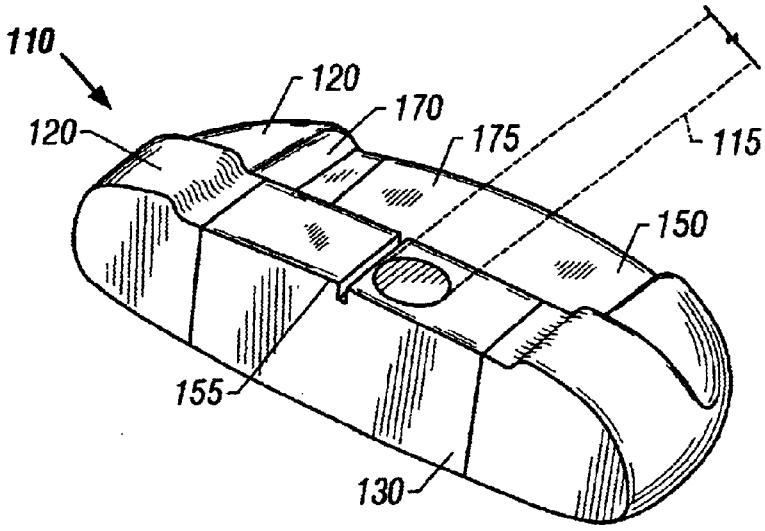
FIG. 1 is a front perspective view of a golf club head constructed in accordance with the present invention.

FIGS. 1–7 show various views of a putter-type golf club head 115. With reference to FIG. 1, there is shown a front, perspective view of the club head 110 comprised of a body that attaches to a club shaft 115. For clarity of illustration, the club shaft 115 is shown in FIG. 1 using phantom lines, and is not shown in FIGS. 2–7. The club shaft 115 attaches to the club head 115 by mating with a borehole that is located on the club head 110, such as through the use of a hosel that mates the shaft to the club head in a well-known manner. The club shaft 115 can have bent configuration so that it defines a desired angle when the club is in an at-rest position. As an alternative to the borehole, the club head 115 may rather include a hosel that extends upwardly from the club head 115 and that connects to the club shaft 115.

Figure 18:
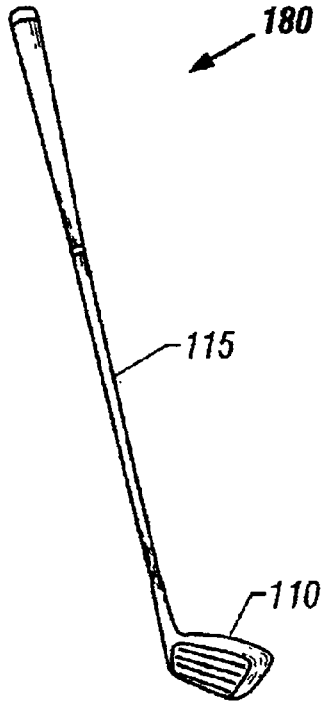
FIG. 18 shows a putter-type golf club having a club head constructed in accordance with the present invention.

The club head 110 and the club shaft 115 collectively form a golf club 180 that can be used to strike a golf ball, such as is shown in FIG. 18. An upper end of the club shaft 115 typically will include a grip that a player grabs when swinging the golf club. FIG. 1 shows the shaft 115 extending outwardly from the club head 110 at a particular angle. It should be appreciated that the shaft 115 can extend outwardly from the club head at a variety of different angles, as will be known to those of skill in the art.

With reference to FIGS. 1–7, the club head 110 has a crown 120 that forms a top surface of the club head 110 and a sole 125 (shown in FIGS. 4, 5–7) that forms a substantially flat, bottom surface of the club head 110. The club head 110 further has a flat strike face 130 for striking a golf ball. A back face 135 is opposed to the strike face 130 and defines the rear periphery of the club head 110. The club head 110 shown in FIGS. 1–7 is a mallet-type club head so that the back face 135 has a rounded, convex contour with respect to the strike face 130. It should be appreciated that the present invention is not limited to mallet-type club heads, but could also be employed in other types of club heads as described further below.

Figure 4:
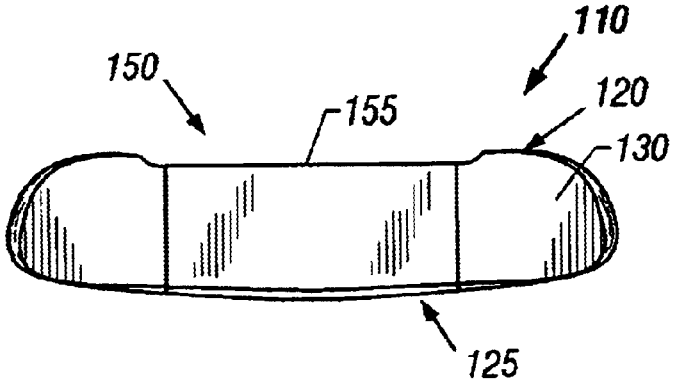
FIG. 4 is front elevational view of the club head shown in FIG. 1.
Figure 5:
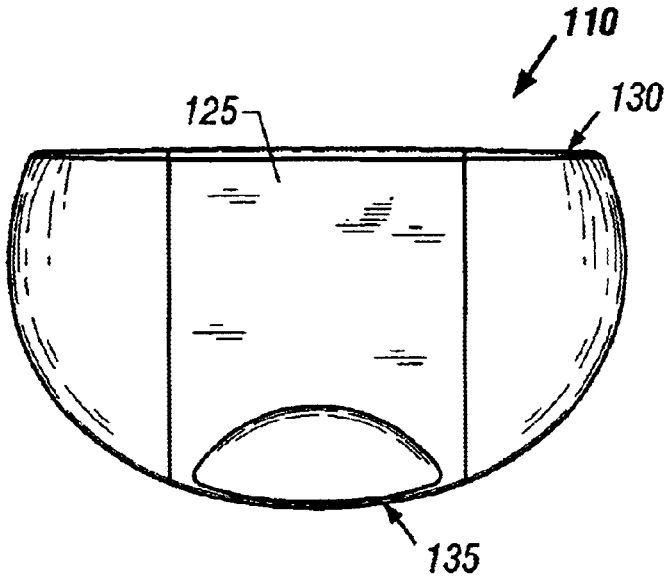
FIG. 5 is a bottom plan view of the club head shown in FIG. 1.

The crown 120 is rounded in both the heel and the toe of the club head 110 so that the heel and toe regions of the club head 110 smoothly merge into the crown 120, thereby providing the club head 110 with a rounded, oblong shape when viewed from the front, as best shown in the front view of FIG. 4. The crown 120 has a multi-level, stepped-configuration such that a first region of the crown 120 is elevated a first distance from the club head's sole 125 and a second region of the crown 120 is elevated a second distance from the club head's sole 125, as can be seen in the side view of FIG. 7. It should be appreciated that the club head of the present invention is not limited to having a particular shape such as shown in the attached figures.

Figure 2:
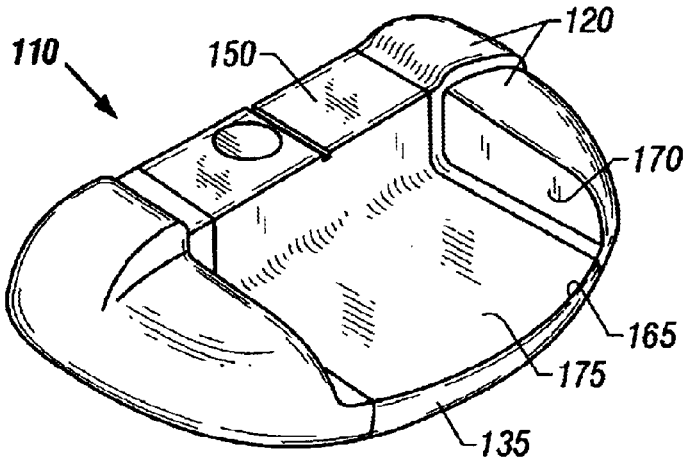
FIG. 2 is a rear perspective view of the club head shown in FIG. 1.
Figure 6:
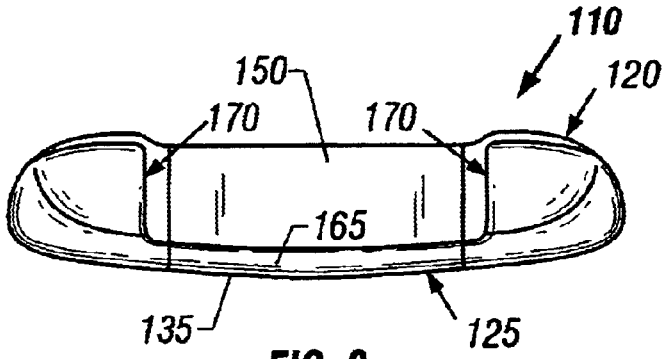
FIG. 6 is a rear elevational view of the club head shown in FIG. 1.
Figure 7:
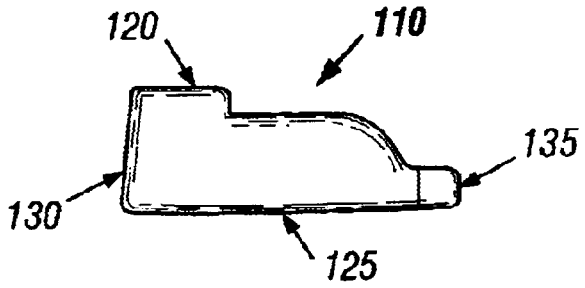
FIG. 7 is a right-side elevational view of the club head shown in FIG. 1.
Figure 8:
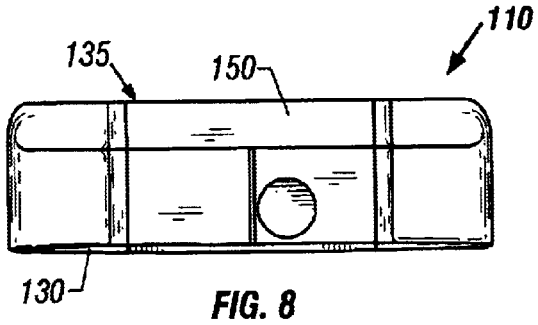
FIG. 8 is a top plan view of another embodiment of a golf club head constructed in accordance with the present invention.
Figure 9:
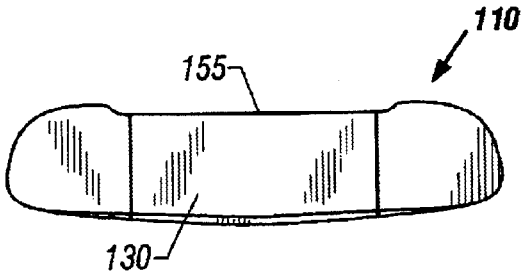
FIG. 9 is front elevational view of the club head shown in FIG. 8.
Figure 10:
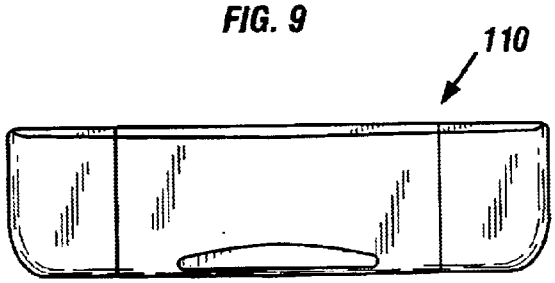
FIG. 10 is a bottom plan view of the club head shown in FIG. 8.
Figure 11:
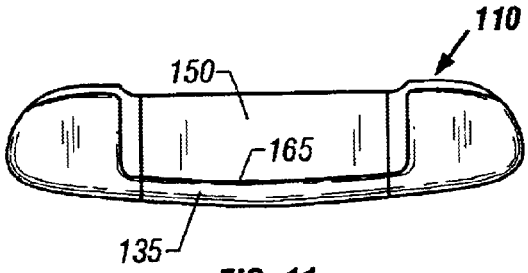
FIG. 11 is a rear elevational view of the club head shown in FIG. 8.
Figure 12:
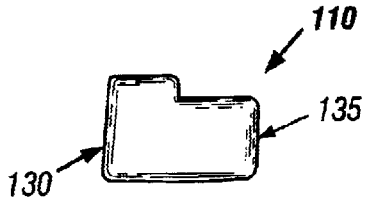
FIG. 12 is a right-side elevational view of the club head shown in FIG. 8.

A channel 150 is located within the crown 120 of the club head 110. The channel 150 extends along a front-back direction on the crown 120 and preferably extends along the entire distance from the strike face 130 to the back face 135 of the club head 110. In this manner, the channel 150 forms a front indentation 155 in an upper region of the strike face 130 at an edge where the strike face 130 merges with the crown 120, as best shown in FIGS. 1 and 4. The front indentation 155 that is formed by the channel 150 thereby affects the distance between the crown 120 and the sole 125 along at least a portion of the strike face 130 and also affects the total area of the strike face 130. The channel 150 also forms a rear indention 165 in an upper region of the back face at an edge where the back face 135 merges with the crown 120, as best shown in FIGS. 2 and 6.

A pair of opposed channel side walls 170 delimit the lateral boundaries of the channel 150. The channel side walls 170 are preferably parallel to one another to thereby provide the channel 150 with a substantially uniform width in the lateral direction (i.e., heel-toe direction) of the club head 110. The substantially uniform size of the channel 150 facilitates its use during alignment of a golf swing, such as during putting, as described more fully below.

A channel bottom wall 175 forms the bottom boundary of the channel 150. In one embodiment, the bottom wall 175 has a stepped configuration such that the bottom wall 175 has two or more tiers or levels. In this manner, the depth (i.e., along the direction from crown to sole) of the channel 150 varies moving from the front of the club head 110 toward the back of the club head 110. It should be appreciated that the configuration of the bottom wall 175 could differ. For example, the bottom wall 175 could be flat, thereby eliminating the multi-tiered steps in the bottom wall 175. The bottom wall 175 could also be sloped or contoured so that the depth of the channel 150 varies either continuously or non-continuously moving along a given direction. As shown in FIGS. 1 and 2, the club shaft 115 mates with the club head 110 in a bore hole that is located in the channel 150 on the bottom wall 175.

The stepped configuration of the bottom wall 175 shown in FIG. 1 is preferred in that it provides the club head 110 with a solid block of mass immediately behind the strike face 130 and a cavity behind the block of mass. This enhances feel for the player when the strike face 130 strikes a golf ball, such as during putting, and also provides the player with improved ball control when striking the ball with the golf club having the club head 110.

The presence of the channel 150 in the club permits an improved distribution of mass in the club head 110 in that the mass that would otherwise be located in the region of the channel 150 is freed up to be located in other regions of the club head 110. This allows the manufacturer to vary the mass/weight distribution of the club head 110 without having to add more mass and thereby increase the weight of the club head 110. The mass that would otherwise occupy the channel 150 is preferably distributed in the toe and heel regions of the club head 110 so that the club head 110 has increased concentration of mass in the toe and heel. As mentioned, the channel 150 forms an indentation 155 in the strike face 130, the indentation being a result of mass that would occupy the region of the indentation if the channel 150 were not present. Preferably, at least a portion of the mass that is freed up by the presence of the indentation 115 is re-located in the sole region of the club head 110.

The mass distribution that is enabled by the presence of the channel 150 results in an increased moment of inertia about the shaft 115, thereby increasing the resistance of the club head to twisting when the club head strikes a golf ball. Thus, when the club head 110 strikes a golf ball at a location that is off-center from the club head's center of gravity, the golf club is less likely to twist in the player's hands, thereby increasing the likelihood that the golf ball will be propelled in a desired direction. The weight distribution that results from the distribution of mass may also be enhanced through the use of certain materials in the club head 110, as well as through the use of certain structures, as described more fully below.

Figure 3:
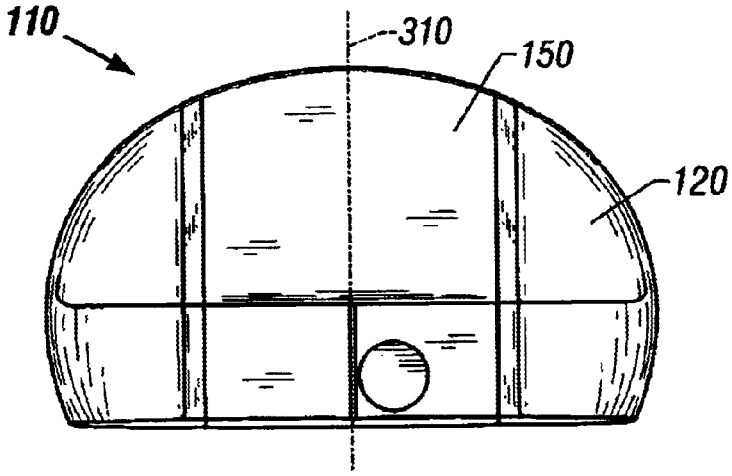
FIG. 3 is a top plan view the club head shown in FIG. 1.

The channel 150 also serves as an alignment aid for the player during swinging or putting of the golf club head 110. As mentioned, the channel 150 extends lengthwise in a direction from the front strike face 130 to the back face 135 of the club head 110. As shown in FIG. 3, in this manner, the channel 150 defines a longitudinal center axis 310 that is aligned with the direction that a golf ball would travel when the strike face 130 properly strikes a golf ball, such as during a putt. The player can thus use the channel 150 in properly aligning the club head 110 during a swing. In the case of a putt, a proper putting motion typically involves the player moving his or her arms in a pendulum-like motion so that the putter shaft defines an imaginary plane during this motion. The axis 310 of the channel 150 would desirably be within the imaginary plane during the putting motion. The channel 150 is preferably located on the crown of the club head 110 so that the player can view the channel 150 and use it as an alignment aid. However, the channel 150 could also be located on the sole, which would still allow for the mass-redistribution described above.

The channel 150 is preferably approximately 0.5 inches to 3.0 inches in width in the toe-heel direction. More preferably, the channel 150 is approximately 1.25 inches to 2.5 inches in width. Even more preferably, the channel is approximately 2 inches in width. The width of the channel 150 is preferably larger than the diameter of a golf ball so that the player can frame the golf ball between the side walls 170 of the channel 150 when aligning the club head, such as prior to a putt. As mentioned, the channel 150 preferably has a substantially uniform width moving from the front of the club head 110 to the back of the club head 110 so that the channel 150 provides a player with a clear indication of the direction and position of the central axis 310 when the club head 110 is viewed from the top. However, it should be appreciated that the width of the channel 150 could also vary moving from the front to the back of the club head 110. For example, the width of the channel 150 at the front indentation 155 may be larger than the width of the channel 150 at the back indentation 165. Preferably, the width of the channel 150 at the front indentation 155 is larger than the diameter of a golf ball.

FIGS. 8–12 show another embodiment of the golf club head 110, wherein the club head 110 is a blade-type putter head. In the blade-type putter head, the back face 135 is substantially straight, rather than being convex, as in the mallet-type head shown in FIGS. 1–7. The blade-type putter head 110 of FIGS. 8–12 also includes a channel 150 that is preferably located on the crown of the putter head 110 so that the channel 150 can function as an alignment aid. As discussed above with respect to the mallet-type embodiment, the channel 150 forms an indentation 155 in the strike face 130 of the putter head 110. The channel 150 also forms an indentation 165 in the back face 135 of the putter head 110.

Figure 13:
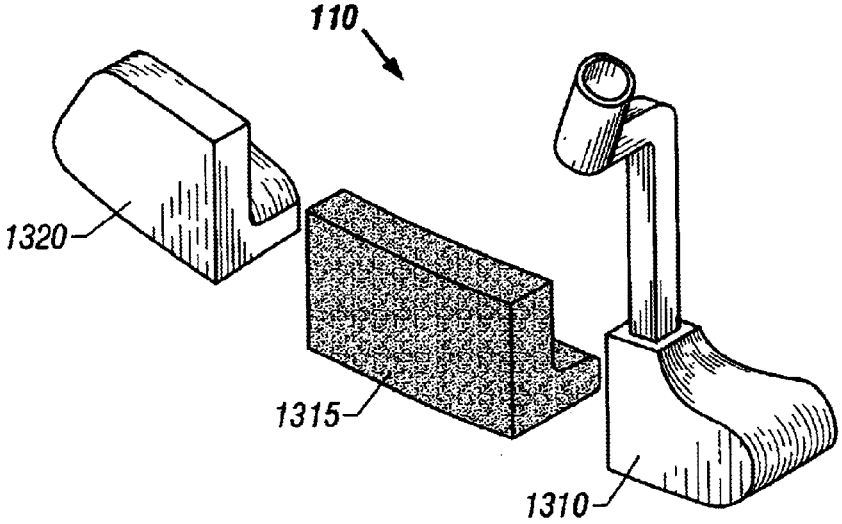
FIG. 13 is an exploded view of a club head of plural segments that collectively form a club head in accordance with the invention.
Figure 14:
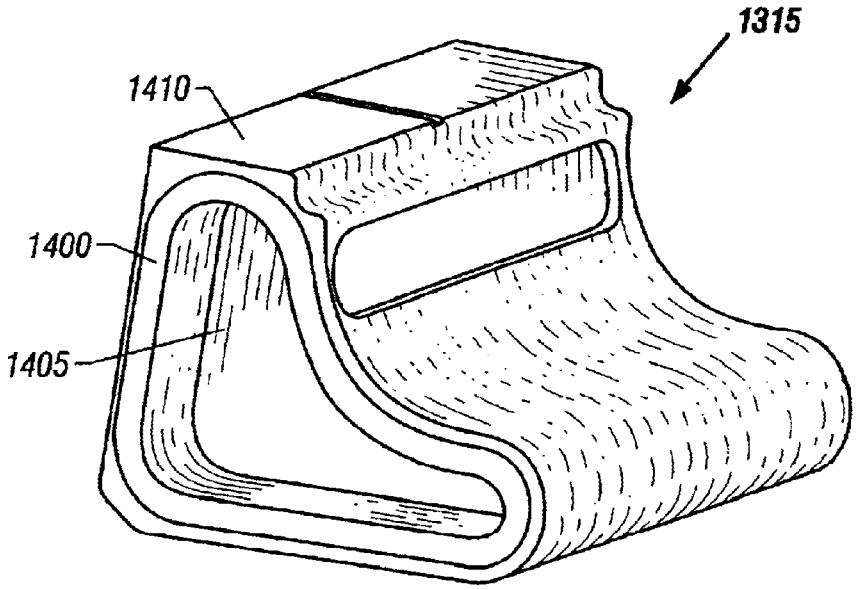
FIG. 14 is a back perspective view of a center segment of the club head.
Figure 15:
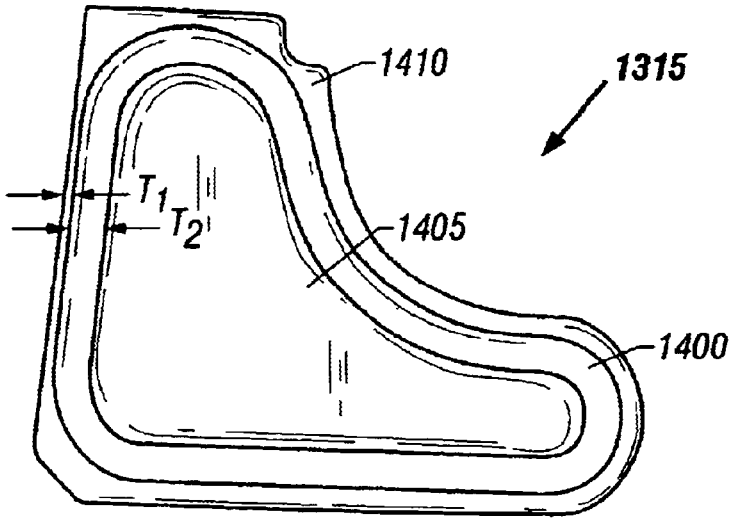
FIG. 15 is a heel side view of the center segment of FIG. 14.
Figure 16:
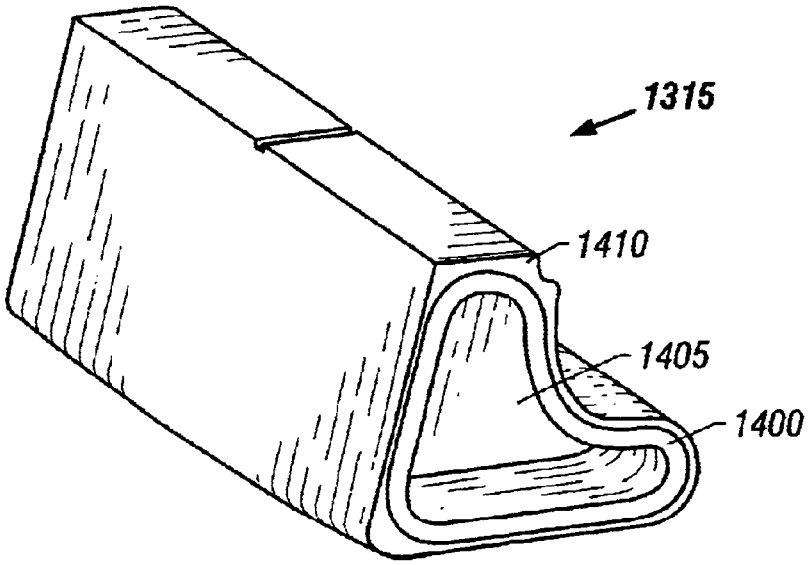
FIG. 16 is a strike face perspective view of the center segment of FIG. 14.
Figure 17:
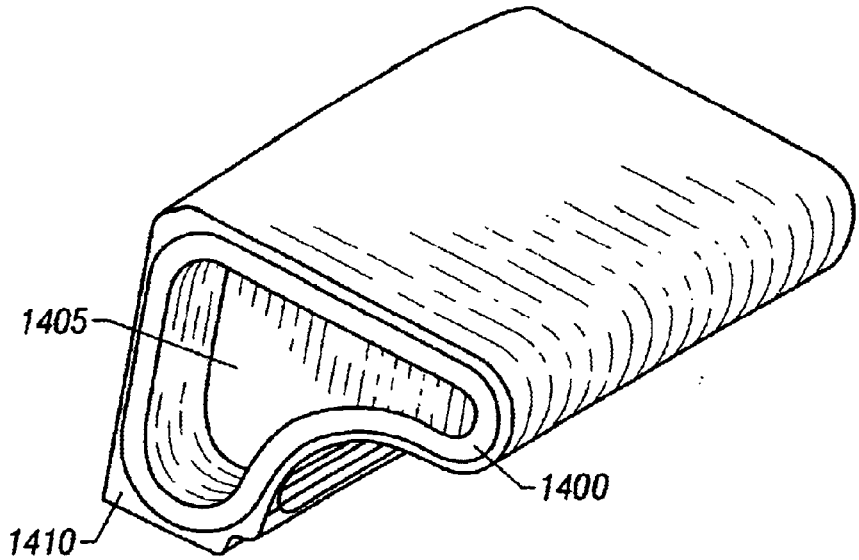
FIG. 17 is a sole perspective view of the center segment of FIG. 14.

The club head 110 may be manufactured of a variety of materials that are known to those of skill in the art. The club head 110 may comprise a unitary piece of material, although in a preferred embodiment, the club head 110 comprises two or more segments of material that are joined together to collectively form the club head 110. FIG. 13 shows a putter-type club head 110 that is comprised of three segments, including a heel segment 1310, a center segment 1315, and a toe segment 1320. For clarity of illustration and reference, FIG. 13 shows the club head 110 in an exploded configuration with the segments 1310, 1315, 1320 separated from one another, although in use the segments are joined to collectively form a putter head 110. It should be appreciated that the segments 1310, 1315, and 1320 are not limited to having the particular shapes shown in FIG. 13. The segments 1310, 1315, 1320 may be shaped such that, when joined together, they would collectively form a club head having other club head shapes, such as the shapes shown in the embodiments of FIGS. 1–12. Moreover, the club head 110 can include more than two segments or could include only a single segment.

The material of the center segment 1315 is preferably different than the material of the heel segment 1310 and toe segment 1320. Specifically, the center segment 1315 preferably comprises a non-metallic material, as described in more detail below, and the heel and toe segments 1310, 1320 preferably each comprise a metallic material. The metallic material used in the heel and toe segments 1310, 1320 may be the same or different depending on the hitting characteristics desired. As used herein, the term "metallic material" refers to an engineering material that includes at least one metal. Therefore, an organic material having metal would be considered a metallic material. In most cases, the non-metallic material of the center segment 1315 will be softer than the metallic material of the heel segment 1310 and toe segment 1320. The center segment 1315 will thereby cushion and absorb the impact with the ball.

The heel and toe segments 1310, 1320 preferably each comprise a metallic material including at least two metals. The metallic materials preferably each have a final alloy density of at least 7 grams per cubic centimeter. In a more preferred version, the metallic materials each have a final alloy density of 7 to 13 grams per cubic centimeter. In a still more preferred version, the metallic materials each have a final alloy density of 9 to 11 grams per cubic centimeter. In a most preferred version of the invention, the metallic materials each have a final alloy density of approximately 10 grams per cubic centimeter.

The heel and toe segments 1310, 1320 may also each comprise a metallic material wherein a first metal is dispersed in a second metal. The dispersion of the first metal in the second metal may be achieved by powder metallurgy techniques wherein a powder of the first metal is blended with a powder of a second metal and the resulting powder metal blend is compacted and sintered at temperatures below the melting point of both metals. The first metal preferably has a higher density than the second metal. The addition of a high density first metal to a lower density second metal allows the final alloy density of the metallic material of the heel and the toe segments 1310, 1320 to be increased in precision increments. In specific embodiments, the first metal has a density of at least 10 grams per cubic centimeter, and the second metal is selected from the group consisting of iron based alloys, nickel based alloys, and copper based alloys. Specific examples of a suitable first metal include tungsten, tantalum, niobium, and molybdenum. In one embodiment, the metallic material has a final alloy density of at least 10 grams per cubic centimeter and the metallic material has a final alloy density at least 8 times greater than the density of the non-metallic material. The segments 1310, 1315, 1320 may also be made of a fiber reinforced composite material.

FIGS. 14–17 show various views of the center segment 1315, which preferably has a multipiece construction. The center segment 1315 preferably comprises a shell 1400 that surrounds an inner core 1405. The shell 1400 is surrounded by an overmold 1410 that provides an outer shape to the center segment 1315. The outer surface of the overmold 1410 forms the outer surface of the club head 110. Thus, a front face of the overmold 1410 forms at least a portion of the strike face 130 of the club head. In this regard, the front face of the overmold 1410 is preferably substantially flat. The shape of the overmold 1410 can be varied to provide the center segment 1315 and the club head 110 with any desired outer contour. The center segment 1310 is located on the club head 110 in the region of the channel 150 such that the top surface of the center segment forms the bottom wall 175 of the channel 150. Thus, the overmold 1410 can be shaped so as to provide the bottom wall 175 of the channel with any desired shape.

The overmold 1410 is preferably manufactured of a pigmented, filled epoxy which is insert injection molded around a subassembly comprised of the core 1405 and shell 1400. The overmold 1410 has a preferred thickness of 0.015–0.100 inch. The properties of hardness, damping capacity, wear and weather resistance, and cosmetic appearance are preferably the controlling properties for selection of the overmold material. The thickness of the overmold 1410 can be varied to affect assembly vibration transmission when a golf ball is struck. The overmold 1410 can also be manufactured of an epoxy alloyed with modifiers to increase damping capacity. For example, the overmold 1410 can be rubber filled, metal flake or particle, etc.

The core 1405 may have a shape that corresponds to the general shape of the body of the putter. In the illustrated embodiment, the core 1405 has a substantially flat bottom surface and a substantially flat front surface that is adjacent the strike face of the club head. In this manner, the properties of the material used to manufacture the core 1405 will influence the feel of the club head 110 when the strike face 130 hits a golf ball. The core 1405 also has a contoured top surface that substantially conforms to the contour of the crown of the club head.

The core 1405 may be manufactured from graphite reinforced epoxy composite by pultrusion, compression molding, or resin transfer molding. Preferably, the material of the core 1405 has favorable mass and sound/vibration attenuation properties. In other embodiments, the core 1405 comprises either of a low cost bulk molded graphite epoxy material, a low cost bulk molded graphite-polyester material, a damping material, such as a polyurethane, a high damping viscoelastic material, such as rubber, or combinations thereof. In yet another embodiment, the center segment 1315 has no core.

The shell 1400 is preferably manufactured from a unidirectional graphite reinforced epoxy composite. The longitudinal stiffness of a material is preferably a controlling property in selecting the material from which the shell 1400 is manufactured. The shape of the shell 1400 generally conforms to the shape of the core 1405. Like the core 1405, the shell 1400 has a front face that is adjacent to the strike face of the club head. Thus, the properties of the shell 1400 will have some effect on the feel of the club head when the strike face impacts a golf ball.

Figure 19:
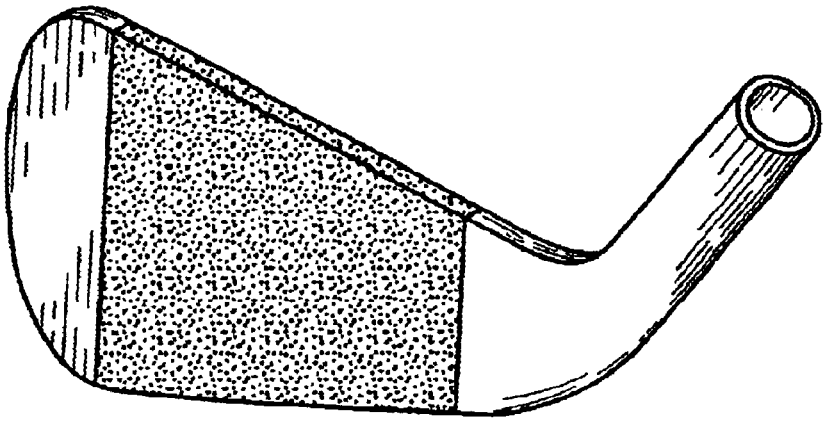
FIG. 19 shows a perspective view of an iron-type club head.
Figure 20:
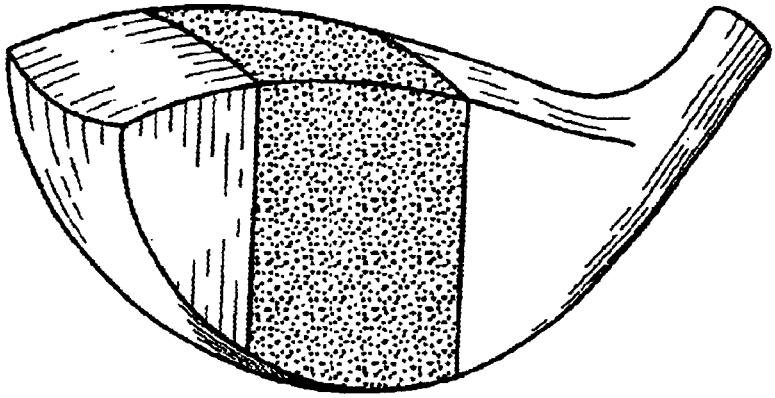
FIG. 20 shows a perspective view of a wood-type club head.

FIGS. 19 and 20 show perspective views of iron and wood type club heads, respectively. The club heads can incorporate channels of the type described above in the context of the putter-type club head 110. Those skilled in the art will understand how to achieve such incorporation, in view of the description above.

The present invention has been described above in terms of a presently preferred embodiment so that an understanding of the present invention can be conveyed. There are, however, many configurations for the disclosed club head not specifically described herein but with which the present invention is applicable. For example, although the invention is described primarily in the context of a putter-type club head, one or more aspects of the invention may be used with other types of club heads, such as irons or woods. The present invention should therefore not be seen as limited to the particular embodiment described herein, but rather, it should be understood that the present invention has wide applicability with respect to golf club heads generally. All modifications, variations, or equivalent arrangements and implementations that are within the scope of the attached claims should therefore be considered within the scope of the invention.

What is claimed:

1. A golf club head comprising a body having a front strike face configured to strike a golf ball and a back face that is generally opposed to the front strike face, the body further having a bottom surface and an opposed top surface, wherein a channel is located in the top surface of the club head, the channel extending from the front strike face to the back face such that the channel forms a first indentation in an upper region of the front strike face and a second indentation in an upper region of the back face of the club head, wherein the body of the golf club head includes plural segments that are attached together to collectively form the body, the plural segments including:

a heel segment extending from the strike face to the back face and being located in a heel region of the club head, the heel segment being formed of a first material having a first density;

a toe segment extending from the strike face to the back face and being located in a toe region of the club head, the toe segment being formed of a second material having a second density; and a center segment extending from the strike face to the back face and being located between the heel segment and the toe segment, the center segment comprising:

an inner core;

a shell surrounding the inner core; and an overmold surrounding the shell, wherein a front face of the overmold forms at least a portion of the strike face of the club head.

2. A golf club head as defined in claim 1, wherein the golf club head comprises a putter-type golf club head that can be used to putt a golf ball.

3. A golf club head as defined in claim 2, wherein the back face is curved with respect to the front strike face so that the putter has a mallet-type head.

4. A golf club head as defined in claim 2, wherein the back face is substantially straight with respect to the front strike face so that the putter has a blade-type head.

5. A golf club head as defined in claim 1, wherein the channel has a width in a heel-toe direction of the club head, the width of the channel being about 0.5 inches to about 3.0 inches.

6. A golf club head as defined in claim 1, wherein the channel has a bottom wall that defines a bottom boundary of the channel, the bottom wall being multi-leveled so as to form at least two steps in the channel.

7. A golf club head as defined in claim 1, wherein the channel has a pair of opposed side walls that define the width of the channel in a heel-toe direction, the pair of opposed side walls being parallel to one another so that the channel has a substantially uniform width moving along a length of the channel from the strike face to the rear face of the club head.

8. A golf club head as defined in claim 1, wherein the channel has a width in a heel toe direction of the club head, the channel width being greater than the diameter of a golf ball.

9. A golf club, comprising the golf club head of claim 3, and a golf club shaft;

a grip on a first end of the shaft; and the golf club head on a second end of the shaft.

* * * * *